US007372969B2

(12) United States Patent
Roeck

(10) Patent No.: US 7,372,969 B2
(45) Date of Patent: May 13, 2008

(54) METHOD FOR PROCESSING AN INPUT SIGNAL TO GENERATE AN OUTPUT SIGNAL, AND APPLICATION OF SAID METHOD IN HEARING AIDS AND LISTENING DEVICES

(75) Inventor: Hans-Ueli Roeck, Hombrechtikon (CH)

(73) Assignee: Phonak AG, Stafa (CH)

( * ) Notice: Subject to any disclaimer, the term of this patent is extended or adjusted under 35 U.S.C. 154(b) by 169 days.

(21) Appl. No.: 11/228,135

(22) Filed: Sep. 16, 2005

(65) Prior Publication Data

US 2006/0013424 A1 Jan. 19, 2006

Related U.S. Application Data

(62) Division of application No. 09/924,753, filed on Aug. 8, 2001, now abandoned.

(51) Int. Cl.
*H04R 25/00* (2006.01)

(52) U.S. Cl. ..... 381/317; 381/312

(58) Field of Classification Search ..... 381/312, 381/315–320

See application file for complete search history.

(56) References Cited

U.S. PATENT DOCUMENTS 4,182,993 A 1/1980 Tyler
4,208,548 A 6/1980 Orban
4,562,591 A 12/1985 Stikvoort
4,934,378 A 6/1990 Perry, Jr.
5,003,606 A 3/1991 Bordewijk
6,359,992 B1 3/2002 Preves et al.
6,516,068 B1 2/2003 Ciurpita et al.
6,628,788 B2 9/2003 Azizi

FOREIGN PATENT DOCUMENTS

EP 1111802 A1 6/2001
GB 1559401 1/1980

OTHER PUBLICATIONS

Search report for Australian Patent Application No. 2001276230, dated Nov. 16, 2007.

*Primary Examiner*—Suhan Ni
(74) *Attorney, Agent, or Firm*—Pearne & Gordon LLP

(57) ABSTRACT

A method and a system for defining a threshold value ($O_{max}$, $O_{min}$, $O_{TR}$) serving to limit the output signal of a processing unit which is fed an input signal. An input-signal level is determined and the threshold value ($O_{max}$, $O_{min}$, $O_{TR}$) is set as a function of that input-signal level. By virtue of the fact that the threshold value is set as a function of the input-signal level, i.e. in adaptive fashion, it is also possible to limit transient noise whose level is well below the maximum value of the threshold value. As a result, when the method or system is applied in a hearing aid, the hearing comfort of the wearer of the hearing aid can be significantly enhanced.

13 Claims, 1 Drawing Sheet

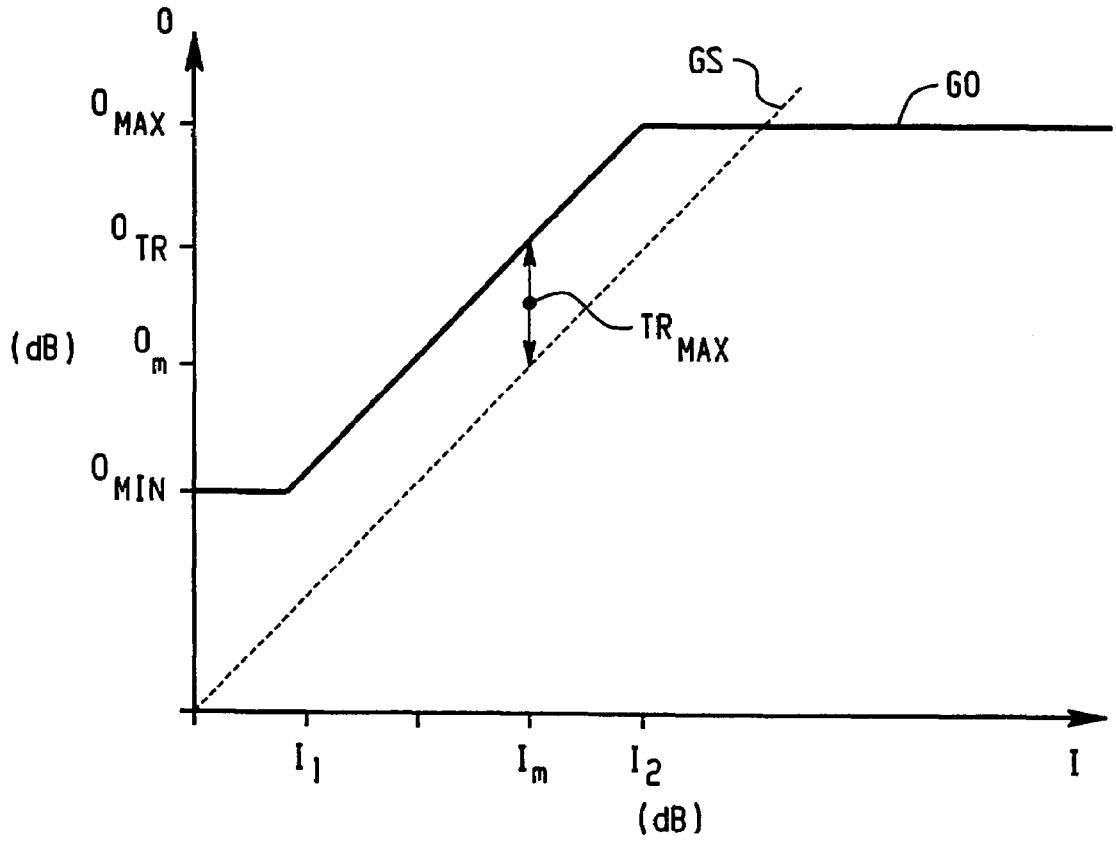
O
O MAX
O TR
(dB)
O m
O MIN
GS
GO
TR MAX
I 1
I m
I 2
I
(dB)

METHOD FOR PROCESSING AN INPUT SIGNAL TO GENERATE AN OUTPUT SIGNAL, AND APPLICATION OF SAID METHOD IN HEARING AIDS AND LISTENING DEVICES

CROSS REFERENCE TO RELATED APPLICATION

The subject application is a division of U.S. application Ser. No. 09/924,753 filed on Aug. 8, 2001, which is now abandoned.

BACKGROUND OF THE INVENTION

This invention relates to a method for processing an input signal to generate an output signal, and to applications of that method in hearing aids and listening devices.

So-called transient limiters are signal processing units which are capable, without any delay or overshoot, of limiting rapidly ramping, short-duration i.e. transient signal components to a predefined level, hereinafter referred to as the threshold value. The threshold value concerned, at which the transient limiter performs its function, is not signal-dependent but can instead be set as a parameter. Transient limiters are employed for instance in hearing aids which serve to compensate for a patient's hearing impairment, but also in auditory amplification systems which are used for enhancing audibility in special situations such as listening and monitoring operations. In the following description the term "hearing aid" is to be understood as comprehensively referring to the medical hearing aids and to the listening devices mentioned above. Where any of the following elucidations relate uniquely to applications in listening devices, they will be explicitly identified as such.

In hearing aids, transient limiters serve the purpose of preventing the maximum output level in the hearing aid from exceeding a predefined threshold value. This protects the user of the hearing aid from excessive noise exposure.

It is a known fact that human speech occupies a dynamic range of about −15 to +18 dB (decibels) around the respective mean level; in quiet surroundings with little ambient noise, that mean level is about 60 to 65 dB. In loud surroundings the mean level can rise to about 80 dB or higher. Given these facts, the conventional methods for limiting the audio signal components for persons with normal hearing have employed fixed maximum values of 100 to 120 dB. In cases of diminished hearing capacity the threshold value is suitably set at a comfortable maximum level below the threshold of pain for the patient or user.

It is a characteristic aspect of human auditory perception that not only sounds above the maximum threshold value or comfort level are bothersome. Indeed, it is also transient sounds (such as intermittent noise), even when at a level distinctly below the maximum threshold value, that are perceived as unpleasant in an otherwise prevalently quiet environment. For example, in quiet surroundings, the transient noise of dishes and cutlery, even if well below the maximum threshold value of 100 to 120 dB, creates an unpleasant auditory sensation.

SUMMARY OF THE INVENTION

It is therefore the objective of this invention to introduce a method by which the aforementioned problems are avoided.

This objective is achieved by means of the measures specified in the characterizing part of claim 1. Additional claims cover advantageous implementational variations of this invention as well as various applications of said method.

By setting the threshold value as a function of the level of the input signal, i.e. adaptively, it is possible to limit even transient noise whose level is well below the maximum threshold value, thus permitting a significantly greater hearing comfort for the wearer of the hearing aid.

BRIEF DESCRIPTION OF THE DRAWING

The following explains this invention in more detail with the aid of a diagrammatic example in which the single FIGURE depicts the pattern of an effective threshold value, selected according to the invention as a function of a given level of the input signal.

DETAILED DESCRIPTION OF THE INVENTION

The method per this invention and its various applications are explained based on the pattern of a threshold value shown in the diagram and adjusted as a function of a given input signal I. This is with initial reference to a person with normal hearing.

In the FIGURE, GO represents the curve of the threshold value set per this invention and indicated by a solid line. GS represents the median curve of the level of an input signal, indicated by a dash-dotted line.

The method per this invention continuously determines a threshold value O which, when necessary i.e. when the level of the input signal is too high, serves as the limiting parameter. To that effect the respective momentary threshold value O is a function of the level I of the input signal. It follows that the threshold value which serves to limit the level of the input signal is continuously adapted to the varying, momentarily prevailing auditory conditions; in other words, the threshold value is adjusted in adaptive fashion.

The threshold value O can be set by first defining a momentary mean level I of the input signal. This may be accomplished for instance by the following approach:

$$I = \frac{1}{T} \cdot \int_0^T |s(t)| \cdot dt$$

Calculated along this formula is a time-based mean value I across the magnitude of the input signal s(t), with the averaging performed over a time interval T which may be a time span of for instance 5 seconds. The formula shown can be applied directly to analog systems. From it, the expert can easily derive a corresponding formula for digital systems.

In another implementational variation of the method per this invention the average or mean level I of the input signal s(t) can be determined strictly on the basis of ambient noise without factoring in any voice signals of interest.

To avoid clipping any voice or speech signals the invention further proposes to set the momentary threshold value O at a point higher by a differential amount $TR_{max}$, than the mean level I. The momentary threshold value is preferably set twenty decibels (dB) above that mean or average level I so that, given the aforementioned dynamic range of voice signals which straddles the mean level from about −15 dB to +18 dB, any voice limitation is prevented.

In the diagram, $I_m$ represents a mean level of the input signal, calculated by the formula shown above. Based on the value for the level $I_m$ a threshold value $O_{TR}$ is set which can be determined by adding a mean output signal $O_m$ to the differential amount $TR_{max}$. The determination per this invention of the momentary threshold value $O_{TR}$ provides significantly greater hearing comfort for the wearer of the hearing aid for as long as the mean level I remains within an interval of $I_1$ to $I_2$. If a mean level I of the input signal were to be set at above the level $I_2$ and the method per this invention as described thus far is applied, the resulting level of the output signal would be above the threshold of pain. Conversely, if the mean level I of the input signal were to be set at below the level $I_1$ and the method per this invention as described thus far is applied, it would pose the risk of at least the first few spoken syllables being clipped, i.e. limited, before the mean level I regains higher values.

Therefore, to prevent the effective threshold value O from rising too high in the case of noisy surroundings, another form of implementation of the method per this invention provides for the establishment of a maximum threshold value $O_{max}$, that value preferably being 120 dB. In the diagram this is expressed by a horizontal progression of the curve GO of the threshold value at $O_{max}$.

Further to the above, another form of implementation of this method provides for the setting of a minimum threshold value $O_{min}$, for the following reason: In quiet surroundings the mean level I quickly drops to values below 45 dB. That would swallow up, i.e. limit, at least any first spoken syllable before the mean level I has returned to 60 dB. This can be avoided by setting a minimum threshold value $O_{min}$, preferably at 80 dB, which then constitutes the lowest acceptable level. The diagram again shows a horizontal progression of the curve GO of the threshold value at $O_{min}$.

As was pointed out further above, the description so far given is based on the application of the method per this invention in the hearing aid i.e. listening device for a person with normal hearing. Where the method per this invention is applied in the hearing aid of a hearing-impaired person, a corresponding adaptation of the numerical parameters is necessary.

The following implementation examples of the method per this invention are specifically aimed at listening device-type hearing aids.

The minimum threshold value $O_{min}$ is amplified by a gain factor averaged over the applicable range. At the same time the maximum value $O_{max}$ for the threshold value O is adjusted to the upper comfort level (UCL) of the person concerned. In addition, the differential amount $TR_{max}$ is adjusted to a user-specific compression ratio. In comprehensive terms the parameters involved, these being the minimum threshold value $O_{min}$, the maximum value $O_{max}$ for the threshold value O and the differential amount $TR_{max}$, are converted into output-specific values. Depending on the fitting function employed, this involves an input-level-dependent amplification of the values $O_{min}$ and $O_{max}$ and a corresponding compression factor for $TR_{max}$. Typical compression factors range from 1 (one), meaning no compression, to four (4).

Another form of implementation provides for a soft or a hard limitation of the input signals. In the case of a hard limitation the output signal, with the correct sign, is limited to the respective level of the threshold value not until that is about to be exceeded. The limit can be viewed as a compression factor of infinite magnitude. In the case of a soft limitation an increasingly larger compression factor is applied even before the threshold value is reached. The concomitant distortion causes any harmonics to weaken, the signal form to look "rounder" and the signal thus limited to have a more pleasant sound.

What is claimed is:

1. A method for determining a threshold value in a hearing device, the threshold value serving to limit an output signal of a processing unit into which an input signal, s(t), has been fed, the method comprising the steps of:

determining a mean value, I, of a level of the input signal in the hearing device;

adjusting the threshold value as a function of the mean value; and limiting the output signal in the hearing device by applying the threshold value, wherein the threshold value is adjusted independently of the output signal, wherein the threshold value is adjusted to an upper value which is equal to the mean level of the input signal plus a preset difference, the output signal being limited by applying the upper value in case the output signal would be higher than the upper value.

2. The method of claim 1, wherein the mean value is determined according to the following formula:

$$I = \frac{1}{T} \cdot \int_0^T |s(t)| \cdot dt$$

wherein T represents a time interval.

3. The method of claim 1, wherein the upper value is always less than an upper comfort level.

4. The method of claim 1, wherein the threshold value is adjusted along a compression ratio for a hearing-impaired person.

5. Use of the method of claim 3, for operating the hearing device for a hearing-impaired person.

6. A method for determining a threshold value in a hearing device, the threshold value serving to limit an output signal of a processing unit of into which an input signal, s(t), has been fed, the method comprising the steps of:

determining a mean value, I, of a level of the input signal in the hearing device;

adjusting the threshold value as a function of the mean value; and limiting the output signal in the hearing device by applying the threshold value, wherein the threshold value is adjusted independently of the output signal, wherein the threshold value is always greater than or equal to a predetermined minimum threshold value.

7. The method of claim 6, wherein the mean value_is determined according to the following formula:

$$I = \frac{1}{T} \cdot \int_0^T |s(t)| \cdot dt$$

wherein T represents a time interval.

8. The method of claim 6, wherein the threshold value is adjusted along a compression ratio for a hearing-impaired person.

9. A method for determining a threshold value in a hearing device, the threshold value serving to limit an output signal of a processing unit of into which an input signal, s(t), has been fed, the method comprising the steps of:

determining a mean value, I, of a level of the input signal in the hearing device;

adjusting the threshold value as a function of the mean value; and limiting the output signal in the hearing device by applying the threshold value, wherein the threshold value is adjusted independently of the output signal, wherein the threshold value is adjusted to an upper value which is equal to the mean value plus a preset difference, the output signal being limited by applying the upper value in case the output signal would be higher than the upper value, and wherein the threshold value is always greater than or equal to a predetermined minimum threshold value.

10. The method of claim 9, wherein the upper value is always less than an upper comfort level.

11. Use of the method of claim 10, for operating the hearing device for a hearing-impaired person.

12. The method of claim 9, wherein the mean value_is determined according to the following formula:

$$I = \frac{1}{T} \cdot \int_0^T |s(t)| \cdot dt$$

wherein T represents a time interval.

13. The method of claim 9, wherein the threshold value is adjusted along a compression ratio for a hearing-impaired person.

* * * * *